US009302192B2

(12) United States Patent
Hsu

(10) Patent No.: US 9,302,192 B2
(45) **Date of Patent: *Apr. 5, 2016**

(54) APPARATUS, METHOD AND SYSTEM FOR INTERACTING AMUSEMENT

(71) Applicant: Generalplus Technology Inc., Hsinchu (TW)

(72) Inventor: Chia-Sheng Hsu, Hsin Chu (TW)

(73) Assignee: GENERALPLUS TECHNOLOGY INC., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/339,222

(22) Filed: Jul. 23, 2014

(65) Prior Publication Data

US 2014/0335756 A1 Nov. 13, 2014

Related U.S. Application Data

(62) Division of application No. 12/732,738, filed on Mar. 26, 2010, now Pat. No. 8,821,208.

(51) Int. Cl.
*A63H 3/28* (2006.01)

(52) U.S. Cl.
CPC ..... *A63H 3/28* (2013.01); *A63H 2200/00* (2013.01)

(58) Field of Classification Search
CPC ..... H04B 11/00; G10L 19/018; G08C 23/02; G06F 7/00
See application file for complete search history.

(56) References Cited

U.S. PATENT DOCUMENTS

| | | | |
|---|---|---|---|
| 6,737,957 | B1 | 5/2004 | Petrovic et al. |
| 6,773,344 | B1 | 8/2004 | Gabai et al. |
| 7,505,823 | B1 | 3/2009 | Bartlett et al. |
| 2004/0169581 | A1 | 9/2004 | Petrovic et al. |
| 2007/0037475 | A1 | 2/2007 | Spear |
| 2011/0223827 | A1 | 9/2011 | Garbos et al. |

*Primary Examiner* — Jay Liddle
*Assistant Examiner* — Alex F. R. P. Rada, II
(74) *Attorney, Agent, or Firm* — Muncy, Geissler, Olds & Lowe, P.C.

(57) ABSTRACT

The present invention relates to an apparatus and a method for interacting amusement. The apparatus includes an acoustic receiver, a decoder and an interaction generating apparatus. The acoustic receiver receives an external acoustic wave signal and transfers the external acoustic wave signal into an acoustic signal. The decoder receives the acoustic signal. When the external acoustic wave signal has a high-frequency modulation signal, the decoder decodes the high-frequency modulation signal into a complete packet message according to a specific decoding procedure. The interaction generating apparatus receives the complete packet message, and generates an interaction according to the message.

7 Claims, 8 Drawing Sheets

APPARATUS, METHOD AND SYSTEM FOR INTERACTING AMUSEMENT

CROSS REFERENCE TO RELATED APPLICATIONS

This application is a Divisional of co-pending application Ser. No. 12/732,738, filed on Mar. 26, 2010, for which priority is claimed under 35 U.S.C. § 120, the entire contents of all of which are hereby incorporated by reference.

BACKGROUND OF THE INVENTION

1. Field of the Invention

The present invention relates to an apparatus and a method for amusement, and more particularly to an apparatus and a method for interacting amusement.

2. Related Art

After the infant child is born to contact the external world, the child is grown around games in the daily life and explores the unknown things by playing toys in the games to further know the external world and satisfy his/her own curiosity. During the growing process of the child, the toy is an indispensable medium in the games.

With the progress of the technology, the toys have been developed from the simple dolls and building blocks to the currently popular intelligent (wise) toy. Recently, nothing is better than the apparatus for interacting amusement in the popular electronic audio-visual game consoles. The so-called apparatus for interacting amusement outputs active behaviors from the apparatus. For example, the apparatus for interacting amusement may be an "electronic pet", such as the well known eChicken, Furby, iDog and the like, early sold in the market. The "electronic pet" is a game console which actively operates in response to a user's command. In addition, the most popular apparatus for interacting amusement is the Wii game console available from Nintendo Company so that the player can interact with the image on the display through the real striking and waving and more fun of game may be obtained.

However, all the apparatuses for interacting amusement only can respond to the user's command under the limitations of their designs. So, these toys are limited to the interactions between the human and the machine.

SUMMARY OF THE INVENTION

It is therefore an objective of the present invention to provide a system and an apparatus for interacting amusement, wherein a specific carrier is added to an acoustic wave so that the interactive game apparatus can respond with a specific reaction to provide the entertainment effect to the user.

Another objective of the present invention is to provide a method for interacting amusement, wherein a demodulation mechanism is added to a game console, and a specific carrier, which is hard to be recognized by the human ears, is added to an acoustic wave, played by an acoustic player, so that the apparatus performs a specific reaction according to the interactive carrier.

In view of this, the present invention achieves the above-identified objectives by providing a system for interacting amusement. The system includes an external acoustic generating apparatus and an interacting amusement apparatus. The external acoustic generating apparatus generates an external acoustic wave signal, which is modulated into a high-frequency modulation signal. The interacting amusement apparatus according to the present invention includes an acoustic receiver, a decoder and an interaction generating apparatus. The acoustic receiver receives the external acoustic wave signal and transfers the external acoustic wave signal into an acoustic signal. The decoder is coupled to the acoustic receiver and receives the acoustic signal. When the acoustic signal has the high-frequency modulation signal, the decoder decodes the high-frequency modulation signal into a complete packet message according to a specific decoding procedure. The interaction generating apparatus is coupled to the decoder, receives the complete packet message, and generates an interaction according to the message.

According to the system and the apparatus for interacting amusement according to the preferred embodiment of the present invention, a carrier frequency of the high-frequency modulation signal is higher than 17 KHz. In addition, in a preferred embodiment, the high-frequency modulation signal is modulated according to a frequency shift keying, and the specific decoding procedure is a frequency shift keying modulation decoding procedure. In one preferred embodiment, the decoder includes an analog-to-digital converter, a spectrum analyzer, a binary data decision circuit, a package header comparing circuit and an error correcting circuit. The analog-to-digital converter receives the acoustic signal, and converts the acoustic signal into a digital signal. The spectrum analyzer receives the digital signal, analyzes a frequency spectrum of the digital signal and outputs a frequency envelope. The binary data decision circuit is coupled to the spectrum analyzer, receives the frequency envelope and a clock signal, and generates two-bit data according to the clock signal and the frequency envelope. The package header comparing circuit is coupled to the binary data decision circuit, receives the two-bit data and compares a predetermined packet header bit with the two-bit data to extract the complete packet message. The error correcting circuit is coupled to the package header comparing circuit, receives the complete packet message, and performs an error correction code calibration to ensure correct contents of the complete packet message.

According to the system and apparatus for interacting amusement according to the preferred embodiment of the present invention, the interacting amusement apparatus is a doll, and the interaction comprises moving at least one of extremities of the doll. In another embodiment, the interaction includes generating an acoustic message corresponding to the external acoustic wave signal. In still another embodiment, the external acoustic generating apparatus may be implemented by a television, a DVD player, a CD player, a radio, a personal computer, a public audio broadcasting apparatus, another interacting amusement apparatus or any one of combinations thereof.

The present invention also provides a method for interacting amusement. The method includes the steps of: providing an external acoustic wave signal; adding a high-frequency modulation signal to the external acoustic wave signal; providing an interacting amusement apparatus having an acoustic receiver; receiving the external acoustic wave signal using the interacting amusement apparatus; decoding the high-frequency modulation signal into a complete packet message; and generating an interaction according to the complete packet message using the interacting amusement apparatus.

In the method for interacting amusement according to the preferred embodiment of the present invention, a carrier frequency of the high-frequency modulation signal is higher than 17 KHz. In addition, in one preferred embodiment, the high-frequency modulation signal is modulated according to a frequency shift keying, and the specific decoding procedure is a frequency shift keying modulation decoding procedure.

In one preferred embodiment, the step of decoding the high-frequency modulation signal into the complete packet message includes the sub-steps of: converting the external acoustic wave signal into a digital signal; analyzing a frequency spectrum of the digital signal to output a frequency envelope; generating two-bit data according to a clock signal and the frequency envelope; and comparing the two-bit data with a predetermined packet header bit to extract the complete packet message.

The essence of the present invention is to add a demodulation mechanism to the game console and to add a specific carrier, which is hard to be recognized by the human ears, to an acoustic wave played by the acoustic player so that the interactive game console can perform a specific reaction according to the information corresponding to the specific carrier. Thus, the present invention may provide the entertainment effect to the user.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
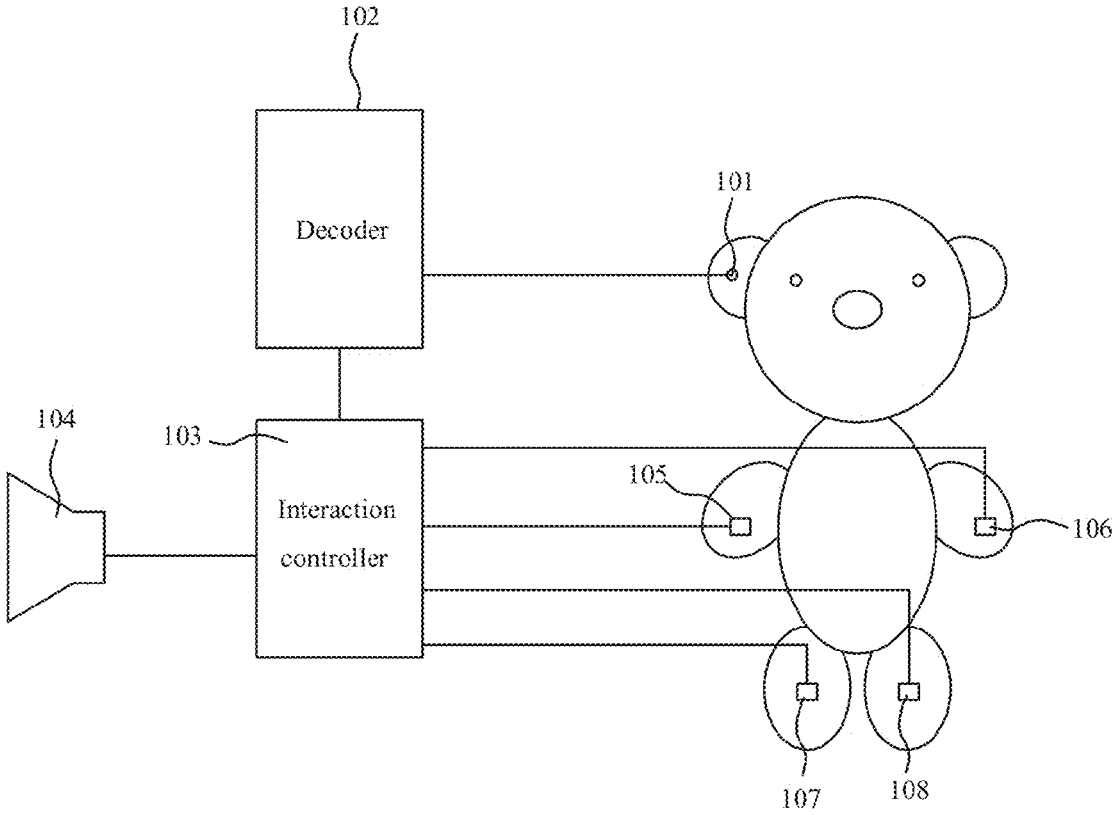
FIG. 1 is a schematic illustration showing an apparatus for interacting amusement according to a preferred embodiment of the present invention.

FIG. 1 is a schematic illustration showing an apparatus for interacting amusement (also referred to as an interacting amusement apparatus) according to a preferred embodiment of the present invention. As shown in FIG. 1, a bear doll serves as an example of the apparatus for interacting amusement according to the embodiment of the present invention. This apparatus includes an acoustic receiver 101, a decoder 102 and an interaction generating apparatus. The interaction generating apparatus of this embodiment includes, for example, an interaction controller 103, a speaker 104, and hand/foot driving mechanisms 105, 106, 107 and 108.

Figure 2:
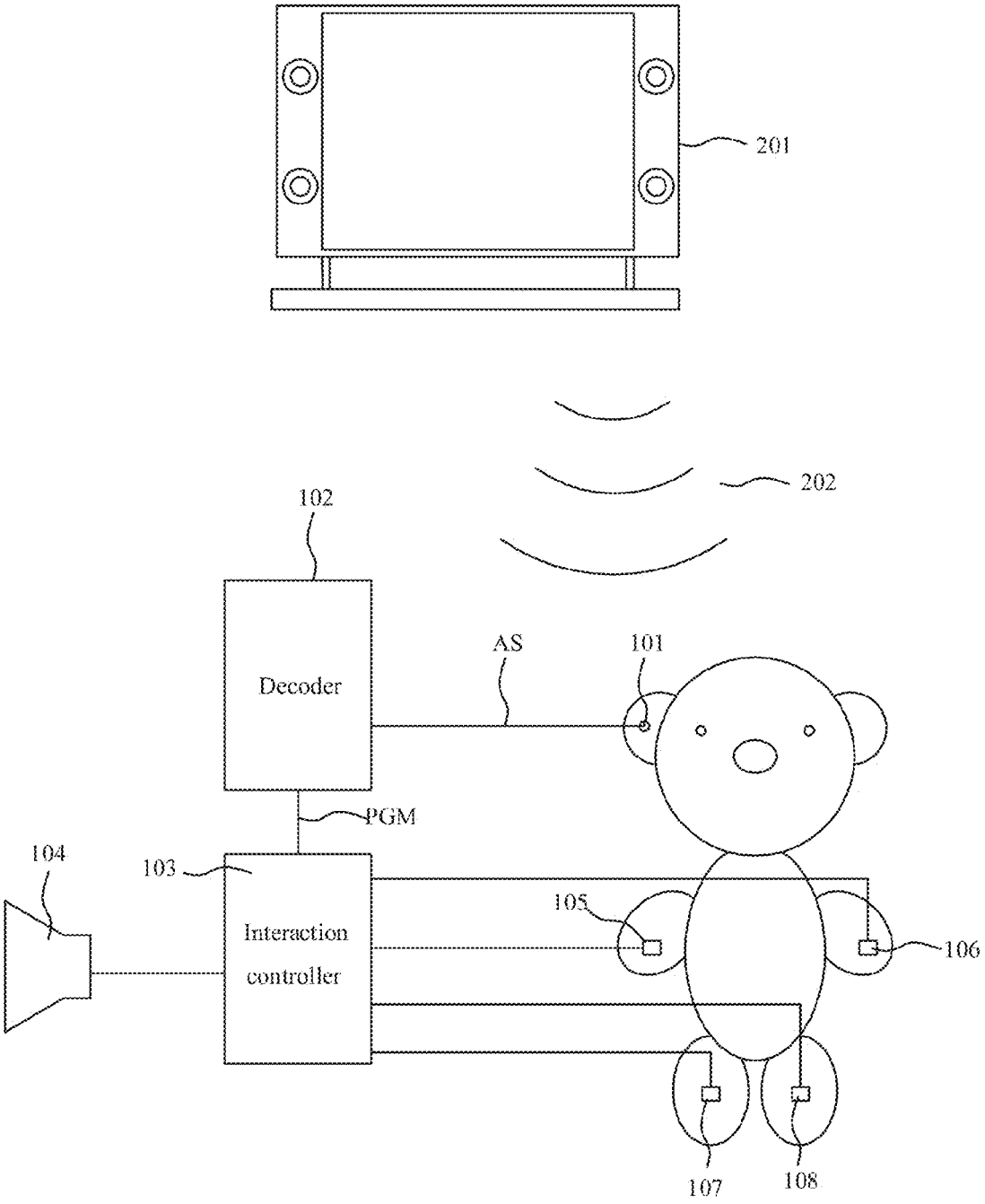
FIG. 2 is a schematic illustration showing a system for interacting amusement according to a first embodiment of the present invention.

FIG. 2 is a schematic illustration showing a system for interacting amusement according to a first embodiment of the present invention. Referring to FIG. 2, the system for interacting amusement includes the apparatus of FIG. 1 for interacting amusement, and further includes a television 201. More particularly, a high-frequency modulation signal is added to a portion of an acoustic wave in an external acoustic wave signal 202 emitted from the television 201. The high-frequency modulation signal is modulated to have the frequency, such as the frequency higher than 17 KHz, which cannot be or is hard to be recognized by the human ears. Thus, when the user is watching the television 201, it is hard for the user to realize or it is impossible for the user to realize the abnormal acoustic wave.

When the interacting amusement apparatus starts to operate, it receives the external acoustic wave signal 202 through its acoustic receiver 101. The acoustic receiver 101 transfers the external acoustic wave signal 202 into an acoustic signal AS. The decoder 102 receives the acoustic signal AS. If the acoustic signal has the high-frequency modulation signal, the decoder 102 decodes the high-frequency modulation signal into a complete packet message PGM according to a specific decoding procedure. The interaction controller 103 receives the complete packet message PGM, and controls the speaker 104 or/and the hand/foot driving mechanisms 105, 106, 107 and 108 to perform the designated operation according to the meanings represented by the complete packet message PGM. In order to describe the present invention more clearly, one example will be illustrated to show how the interacting amusement apparatus interacts with the television 201.

For example, the television 201 is connected to a digital multi-function optical disk player, and is playing a digital multi-function optical disk (DVD). The DVD is designed to work in conjunction with the interacting amusement apparatus. The user may hear the acoustic signal of "HELLO" when watching the television. Meanwhile, the interacting amusement apparatus also receives the acoustic signal of "HELLO". According to the above-mentioned decoding procedure, the decoder 102 decodes to obtain the complete packet message PGM. The interaction controller 103 controls the speaker 104 to output the acoustic signal of "HELLO" according to the complete packet message PGM and controls the hand driving mechanism 105 to wave.

The above-mentioned embodiment is only a special example, and the application thereof is not limited to the process of outputting the acoustic wave of "HELLO" or waving the hand driving mechanism 105. If the control mechanism is perfectly designed, answering, dancing or the like may be performed according to the played acoustic signal. So, the present invention is not particularly restricted to the above-mentioned embodiment.

Figure 3:
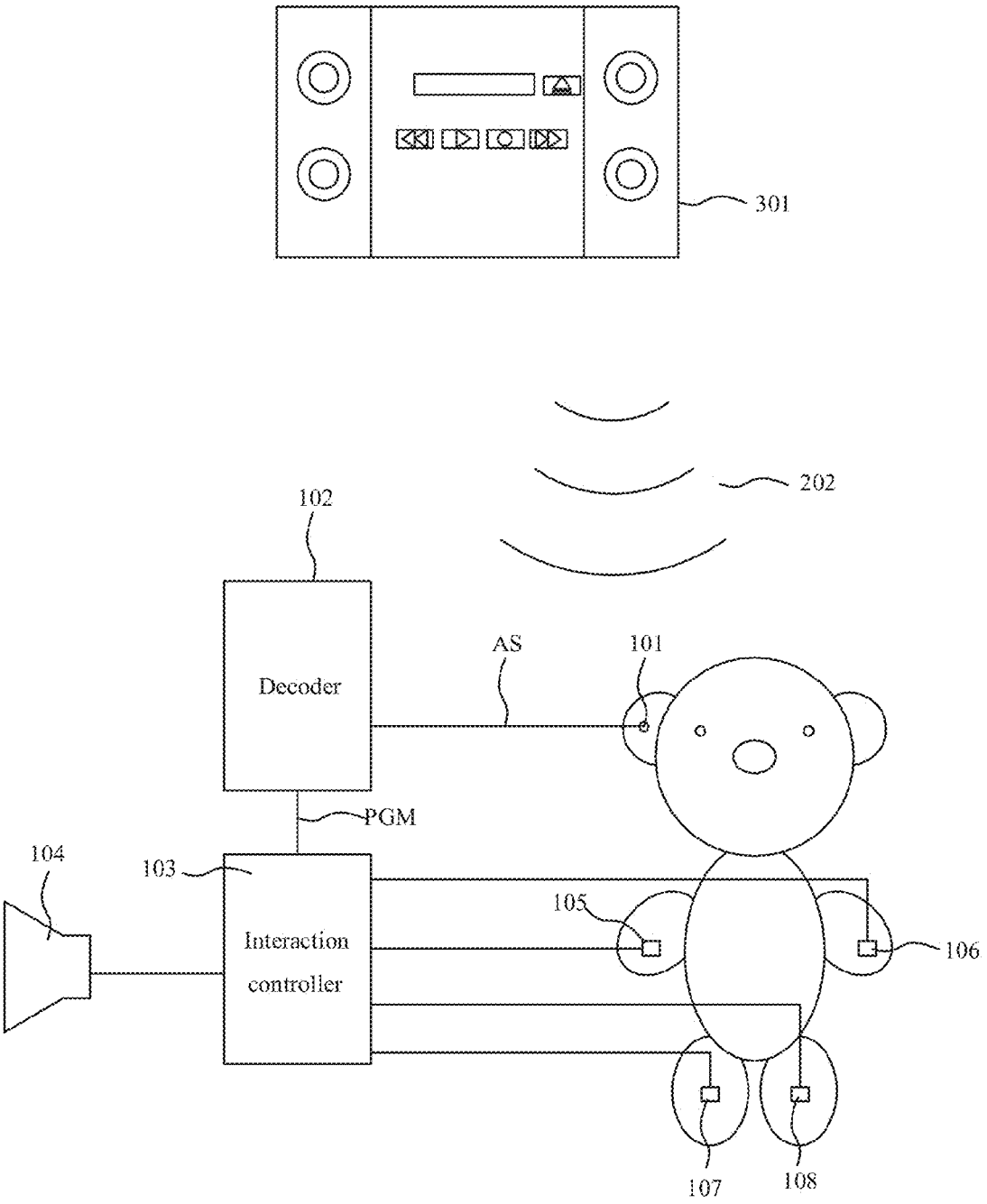
FIG. 3 is a schematic illustration showing a system for interacting amusement according to a second embodiment of the present invention.
Figure 4:
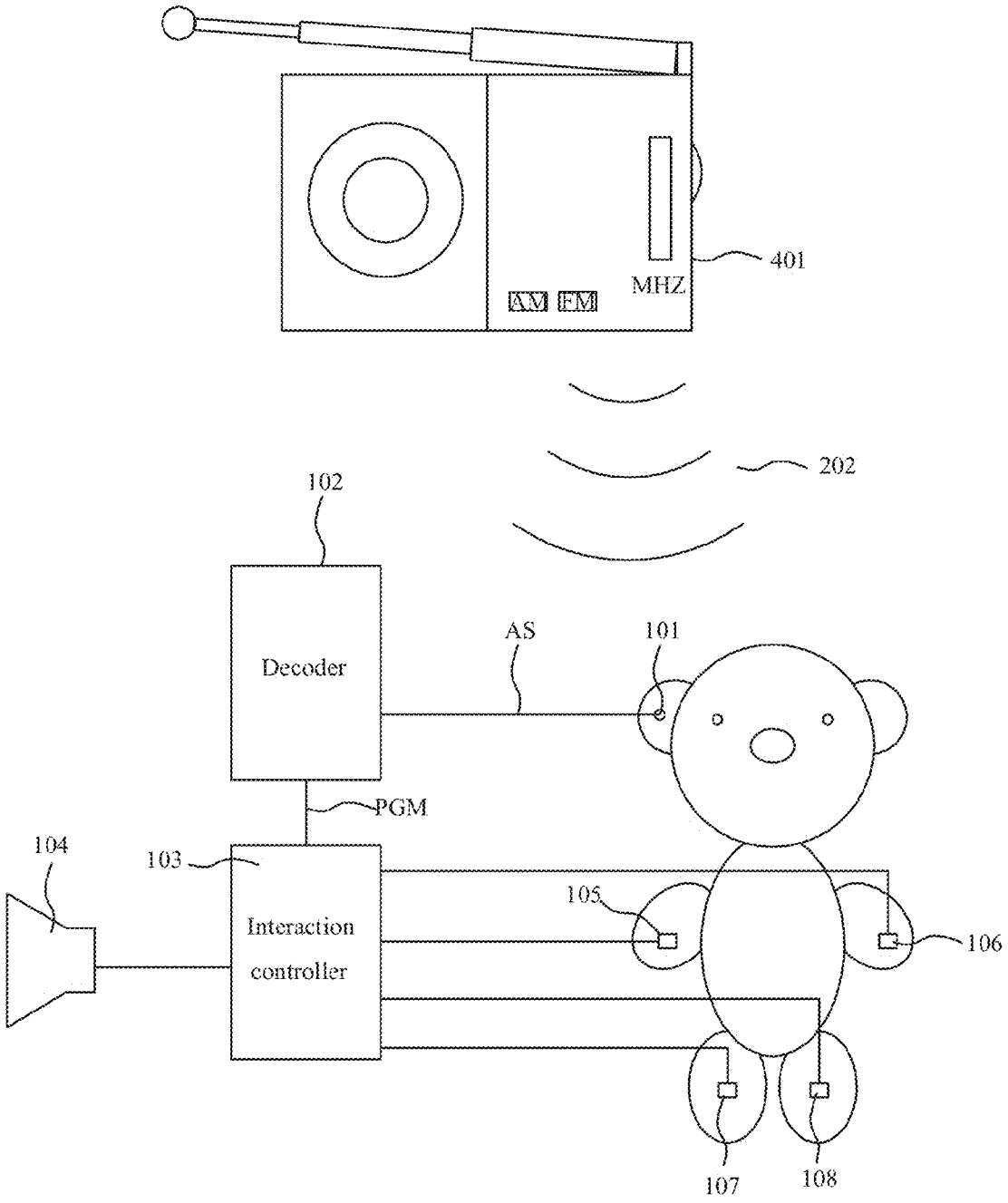
FIG. 4 is a schematic illustration showing a system for interacting amusement according to a third embodiment of the present invention.
Figure 5:
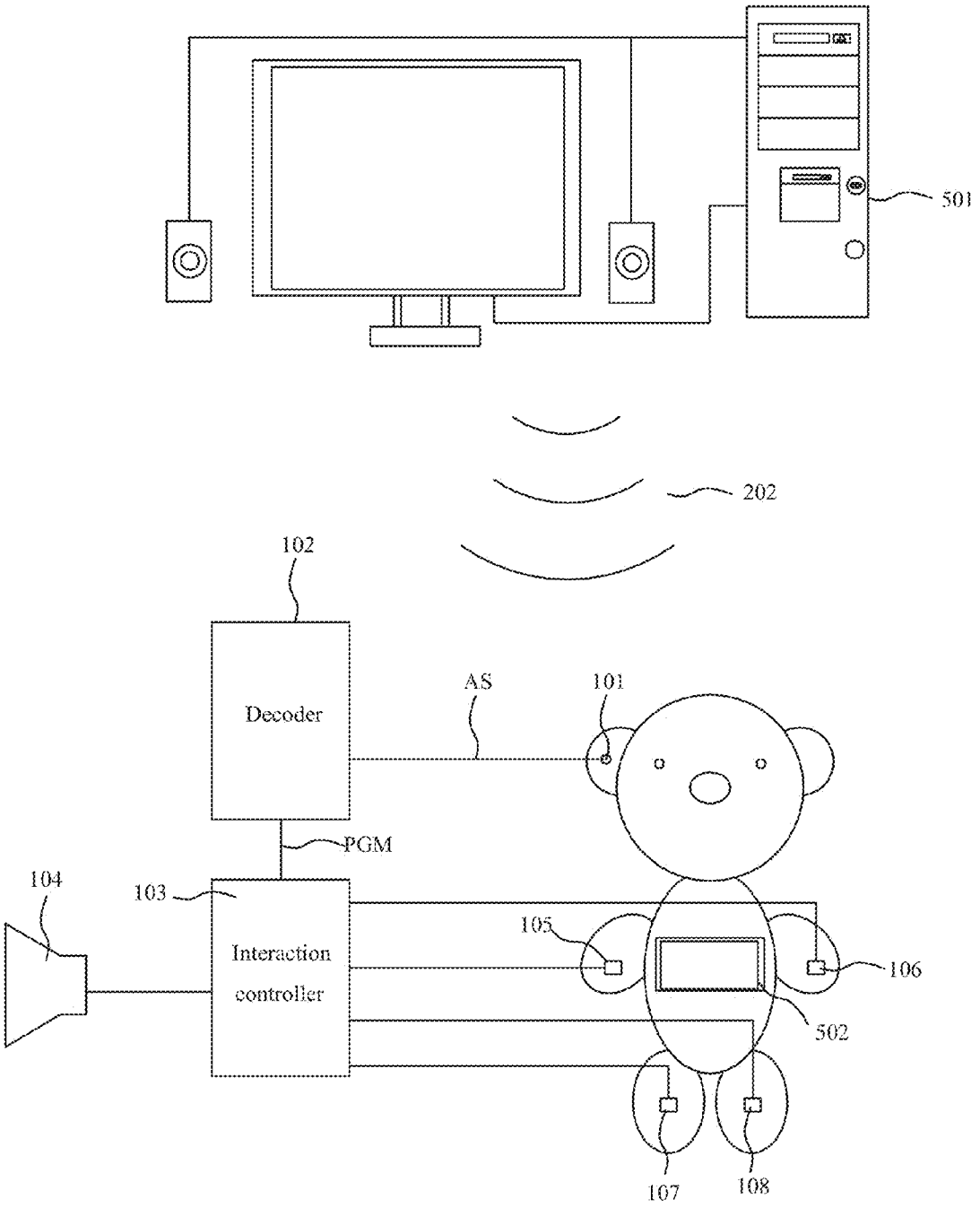
FIG. 5 is a schematic illustration showing a system for interacting amusement according to a fourth embodiment of the present invention.

In addition, although the television 201 serves as an example of the external acoustic generating apparatus in the embodiment, those skilled in the art should understand that the external acoustic generating apparatus has many implementations. FIGS. 3 to 6 are schematic illustrations showing several systems for interacting amusement according to first to fourth embodiments of the present invention. As shown in FIG. 3, the external acoustic generating apparatus is a CD/DVD player 301. Next, as shown in FIG. 4, the external acoustic generating apparatus is a radio 401. In this example, the high-frequency modulation signal is modulated in the broadcasting program, and the acoustic signal of the broadcasting program is modulated by the frequency modulation (FM) or the amplitude modulation (AM), which are referred to as the dual modulation. Next, the external acoustic generating apparatus of FIG. 5 is a personal computer 501. The user can make the speaker of the computer play the modulated acoustic signal by way of network downloading or purchasing a CD or a DVD. In addition, what is special in this example is that an additional display panel 502 is added to the interacting amusement apparatus. In other words, the interacting amusement apparatus may interact with the external acoustic generating apparatus by displaying an image or images.

Figure 6:
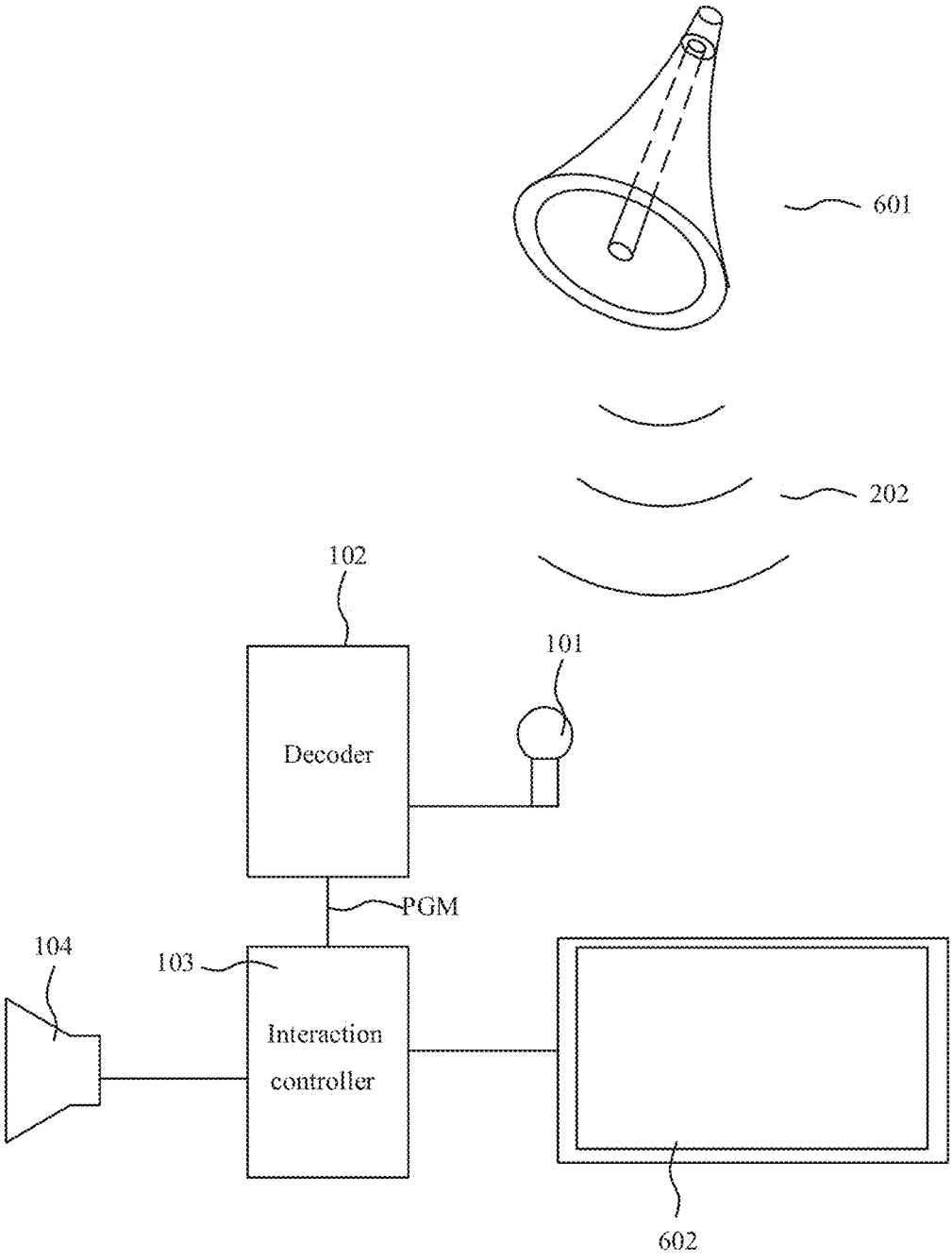
FIG. 6 is a schematic illustration showing a system for interacting amusement according to a fifth embodiment of the present invention.

Finally, as shown in FIG. 6, the external acoustic generating apparatus of FIG. 6 is a public audio broadcasting apparatus 601. In addition, the interacting amusement apparatus of this example further includes an external large-scale display billboard 602, such as a large-scale electronic billboard in a baseball field. For example, when the batter hits a homerun, the high-frequency modulation signal may be added to the acoustic signal 202 when the broadcaster is broadcasting. When the acoustic receiver 101 of the interacting amusement apparatus receives the high-frequency modulation signal of the acoustic signal 202 and after the above-mentioned decoding, the interaction controller 103 can control the large-scale display billboard 602 to display the texts of "HOMERUN" and display a sparkler or the like.

In addition, the suitable modulation should be the frequency shift keying (FSK) modulation. In practice, the center frequency of the FSK modulation may be set to be 18 KHz, 17 KHz is set to be a binary digit 0, and 19 KHz is set to be a binary digit 1. Because the acoustic response of the human's ears on the acoustic signal higher than 17 KHz is not good, the human's ears cannot realize the modulation with the acoustic signal higher than 17 KHz. Although the embodiment is described with the frequency shift keying modulation, those skilled in the art should understand that the FSK modulation is only a non-restrictive example, and may easily adopt another modulation method, such as a phase shift keying modulation (PSK), a differential phase shift keying modulation (DPSK) or a minimum shift keying modulation (MSK).

Figure 7:
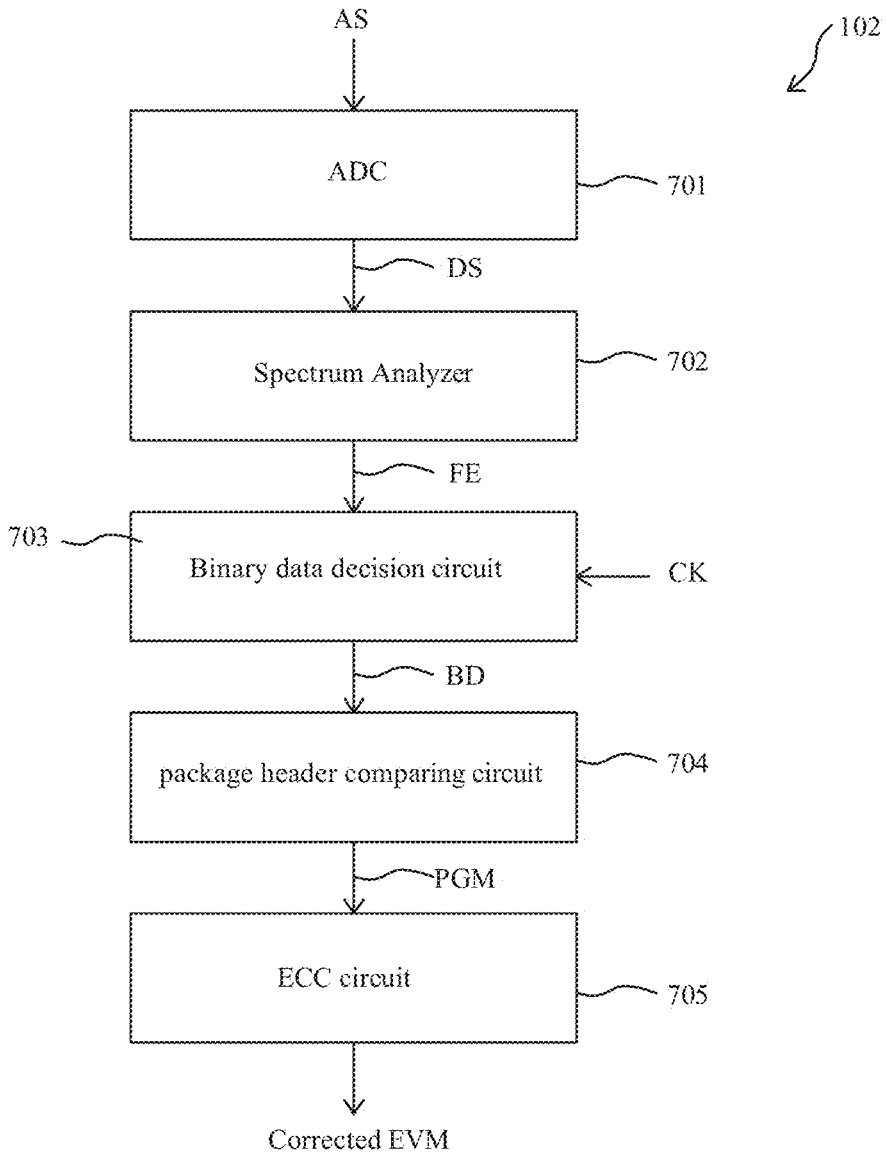
FIG. 7 is a circuit block diagram showing a decoder 102 in the apparatus for interacting amusement according to the preferred embodiment of the present invention.

FIG. 7 is a circuit block diagram showing the decoder 102 in the apparatus for interacting amusement according to the preferred embodiment of the present invention.

Referring to FIG. 7, the decoder 102 includes an analog-to-digital converter 701, a spectrum analyzer 702, a binary data decision circuit 703, a package header comparing circuit 704 and an error correcting circuit 705. The analog-to-digital converter 701 receives the acoustic signal AS and converts the acoustic signal AS into a digital signal DS. The spectrum analyzer 702 receives the digital signal DS, analyzes a frequency spectrum of the digital signal DS and then outputs a frequency envelope FE. The binary data decision circuit 703 receives the frequency envelope FE and a clock signal CK, and generates two-bit data BD according to the clock signal CK and the frequency envelope FE. The package header comparing circuit 704 compares the two-bit data BD with a predetermined packet header bit to extract the complete packet message PGM. The error correcting circuit 705 receives the complete packet message PGM and performs an error correction code calibration to ensure correct contents of the complete packet message PGM.

Figure 8:
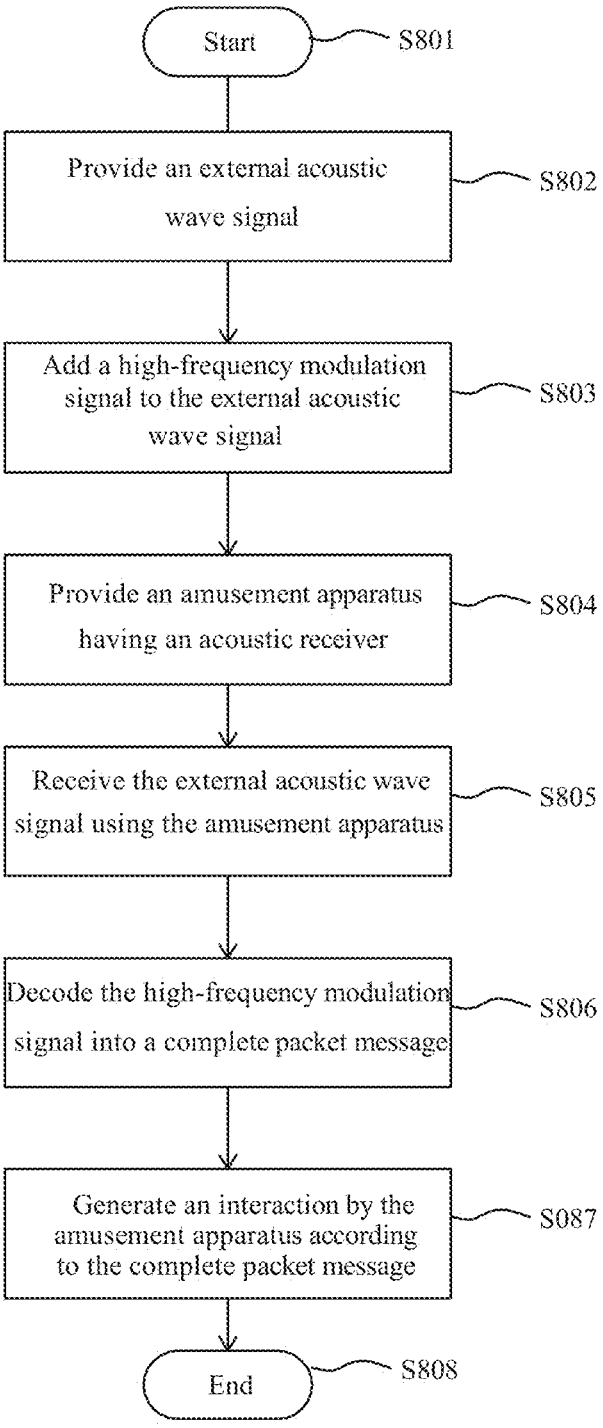
FIG. 8 is a flow chart showing a method for interacting amusement according to the preferred embodiment of the present invention.

According to the above-mentioned embodiments, a method for interacting amusement may be concluded. FIG. 8 is a flow chart showing the method for interacting amusement according to the preferred embodiment of the present invention. Referring to FIG. 8, the method includes the following steps.

In step S801, the method starts.

In step S802, an external acoustic wave signal is provided. The external acoustic wave signal may be provided by a television, a DVD player, a compact disc (CD) player, another interacting amusement apparatus or at least one of the combinations thereof In step S803, a high-frequency modulation signal is added to the external acoustic wave signal by way of frequency shift keying modulation, for example.

In step S804, an amusement apparatus having an acoustic receiver is provided.

In step S805, the external acoustic wave signal is received using the amusement apparatus.

In step S806, the high-frequency modulation signal in the external acoustic wave signal is decoded into a complete packet message.

In step S807, an interaction is generated by the amusement apparatus according to the complete packet message.

In step S808, the method ends.

To sum up, the essence of the present invention is to add the demodulation mechanism to the game console and to add the specific carrier, which is hard to be recognized by the human ears, to the acoustic wave played by the acoustic player so that the interactive game console can perform the specific reaction according to the information corresponding to the specific carrier. Thus, the present invention may provide the entertainment effect to the user.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A method for interacting amusement, the method comprising the steps of:

providing an external acoustic wave signal;

adding a high-frequency modulation signal to the external acoustic wave signal;

providing an interacting amusement apparatus having an acoustic receiver;

receiving the external acoustic wave signal using the interacting amusement apparatus;

decoding the high-frequency modulation signal into a complete packet message; and generating an interaction according to the complete packet message using the interacting amusement apparatus, wherein a carrier frequency of the high-frequency modulation signal is higher than 17 KHz, and the high-frequency modulation signal is a narrow-band modulated signal, wherein, the external acoustic wave signal includes the high-frequency modulation signal, and the step of decoding the high-frequency modulation signal into the complete packet message further comprises:

converting the external acoustic wave signal into a digital signal;

analyzing a frequency spectrum of the digital signal to output a frequency envelope;

generating a binary data stream according to a clock signal and the frequency envelope; and directly extracting the complete packet message from the binary data stream without any de-spreading processing.

2. The method according to claim 1, wherein the high-frequency modulation signal is modulated according to a frequency shift keying, and the specific decoding procedure is a frequency shift keying modulation decoding procedure.

3. The method according to claim 1, wherein the interacting amusement apparatus is a doll, and the interaction comprises moving at least one of extremities of the doll.

4. The method according to claim 1, wherein the interacting amusement apparatus is a doll, and the interaction comprises an acoustic message corresponding to the external acoustic wave signal.

5. The method according to claim 1, wherein the interacting amusement apparatus is a display apparatus, and the interaction comprises changing a display frame corresponding to the external acoustic wave signal.

6. The method according to claim 1, wherein the step of decoding the high-frequency modulation signal into the complete packet message comprises:

converting the external acoustic wave signal into a digital signal;

analyzing a frequency spectrum of the digital signal to output a frequency envelope;

generating two-bit data according to a clock signal and the frequency envelope; and comparing the two-bit data with a predetermined packet header bit to extract the complete packet message.

7. The method according to claim 6, wherein the step of decoding the high-frequency modulation signal into the complete packet message further comprises:

performing an error correction code calibration on the complete packet message to ensure correct contents of the complete packet message.

* * * * *